United States Patent [19]

Wagstaff

[11] 4,421,155

[45] Dec. 20, 1983

[54] MACHINE DUPLICATABLE, DIRECT CHILL FLAT INGOT CASTING MOLD WITH CONTROLLED CORNER WATER AND ADJUSTABLE CROWN FORMING CAPABILITY

[75] Inventor: Frank E. Wagstaff, Spokane, Wash.

[73] Assignee: Wagstaff Engineering, Incorporated, Spokane, Wash.

[21] Appl. No.: 827,587

[22] Filed: Aug. 25, 1977

[51] Int. Cl.[3] ..... B22D 11/124

[52] U.S. Cl. ..... 164/444; 164/435; 164/436

[58] Field of Search ..... 164/418, 443, 444, 435, 164/436, 82, 89, 73

[56] References Cited

U.S. PATENT DOCUMENTS

| | | | |
|---|---|---|---|
| 3,226,782 | 1/1966 | Schultz | 164/418 X |
| 3,688,834 | 9/1972 | Wagstaff et al. | 164/444 |
| 3,710,845 | 1/1973 | Burkhardt et al. | 164/436 |
| 3,739,837 | 6/1973 | Wagstaff et al. | 164/89 X |
| 3,911,996 | 10/1975 | Veillette | 164/435 X |
| 4,069,863 | 1/1978 | Hargassner et al. | 164/436 |

FOREIGN PATENT DOCUMENTS

| | | | |
|---|---|---|---|
| 843287 | 7/1952 | Fed. Rep. of Germany | 164/444 |
| 629368 | 12/1961 | Italy | 164/73 |

*Primary Examiner*—Gus T. Hampilos

*Attorney, Agent, or Firm*—Christopher Duffy

[57] ABSTRACT

The mold comprises a generally rectangularly shaped, machine duplicatable band which is monolithically circumferentially continuous and inherently convexly bowed on the relatively longer and shorter sides thereof, so that it forms crowns on the opposing side walls of the ingot operatively formed therein. The bow in the relatively longer sides of the band has an inherent deflection adapted to form a crown intermediate between that adapted to compensate for shrinkage during the butt forming stage of the casting operation, and that adapted to compensate for shrinkage when the casting operation is conducted at operating speed. However, the relatively longer sides of the band are adapted to flex laterally inwardly and outwardly thereof, and there are drive means connected with the relatively longer sides of the band to flex the same, firstly relatively laterally inwardly thereof to alter the deflection to that adapted to compensate for shrinkage during the butt forming stage, and thence relatively laterally outwardly thereof to alter the deflection to that adapted to compensate for shrinkage when the casting operation is conducted at operating speed.

6 Claims, 8 Drawing Figures

Fig. 1.
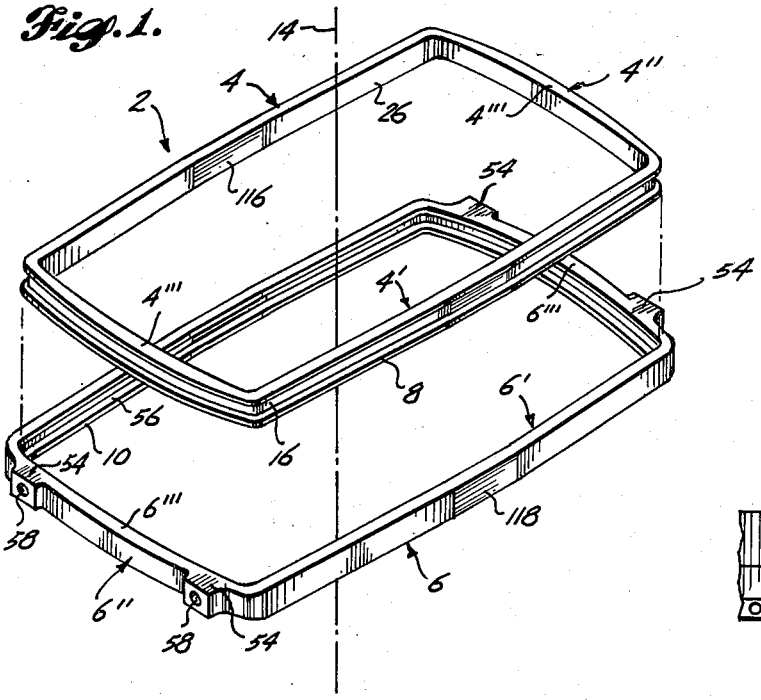
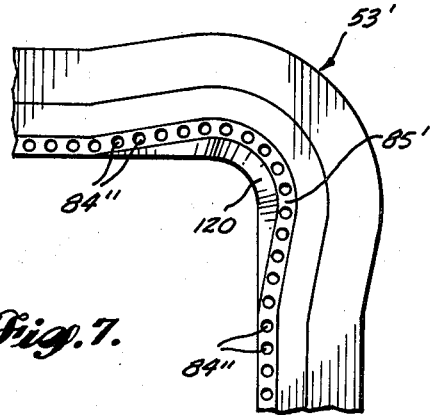
Fig. 7.
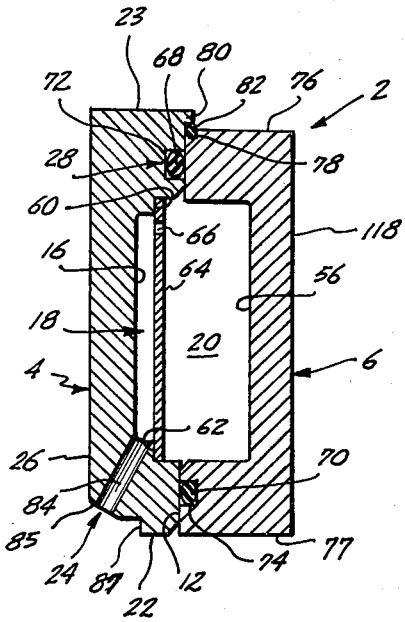
Fig. 2.
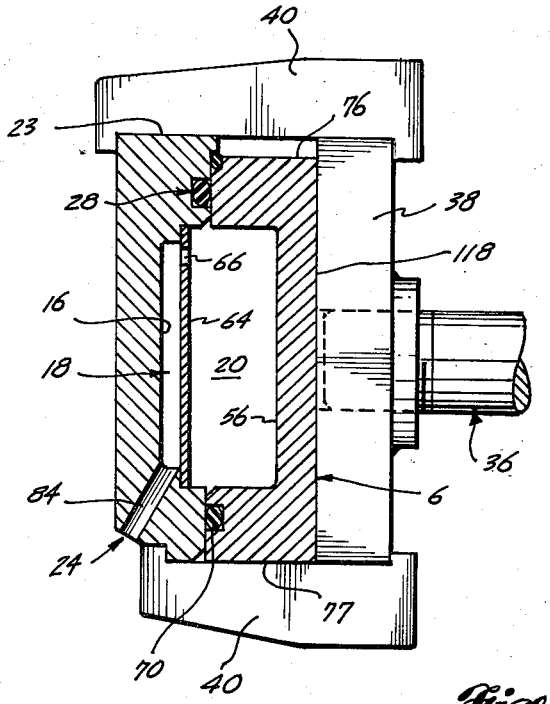
Fig. 4.

MACHINE DUPLICATABLE, DIRECT CHILL FLAT INGOT CASTING MOLD WITH CONTROLLED CORNER WATER AND ADJUSTABLE CROWN FORMING CAPABILITY

THE INVENTION IN GENERAL

This invention relates to a mold for casting flat rectangularly cross sectioned metal ingots by the direct chill casting technique. The mold is adapted to chill all parts of the ingot including the corners of the same; and is adapted to provide a substantially uniform chill effect on all parts of the ingot including the corners of the same. The mold is also adapted to form a crown on the relatively wider and narrower side walls of the ingot, to compensate for the uneven shrinkage which the ingot experiences as it solidifies; and to vary the degree of deflection in the crown formed during the casting operation on the relatively wider side walls of the ingot so that the degree of compensation is varied commensurate with the variation in the rate of shrinkage caused by changes in the speed of the casting operation.

Direct chill casting is a technique in which aluminum or some other molten metal is poured into the inlet end of an open ended mold while liquid coolant is applied to the inner periphery of the mold to solidify the metal as an ingot. Also, the same or a different coolant is normally applied to the exposed surface of the ingot as it emerges from the outlet end of the mold, to continue the cooling effect on the solidifying metal. Where possible, the coolant is applied around the entire periphery of the mold, as well as around the entire periphery of the emerging ingot, to make the cooling effect as uniform as possible. However, because of the cross sectional nature of the mold, the ingot does not cool at a uniform rate throughout the cross section thereof; and moreover, the rate tends to vary not only with the location of the metal in the ingot, but also with the rate at which the metal is being poured into the mold. At the corners, for example, the ingot is exposed to coolant from two sides, and as a result, the corners tend to cool more rapidly than does the balance of the ingot, producing a so-called "cold shut" effect in the metal at the corners. Also, the metal along the side walls of the ingot tends to cool and shrink at an uneven rate, with the result that the side walls tend to "withdraw" inwardly at their centers and lose their flatness. Moreover, the rate of shrinkage along the walls also varies lengthwise of the ingot, inasmuch as when the butt end of the ingot is being formed, the metal is poured at a relatively low rate, whereas when the remainder of the ingot is being formed, the metal is poured at a substantially higher rate, i.e., at the so-called "operating" speed of the mold; and as a result, the rate of shrinkage in the various lengthwise segments of the ingot varies with the rate at which the metal is being poured into the mold.

Molds have been devised which are capable of forming a crown on the wider side walls of the ingot to compensate for the uneven shrinkage which these side walls experience as the ingot solidifies. Also, molds have been devised which are capable of adjusting the degree of deflection in the crown formed on these side walls of the ingot when the casting speed of the mold is increased from the intitial low speed during the butt forming stage, to the higher operating speed during the remainder of the operation. For example, see U.S. Pat. Nos. 3,911,996, 3,933,192, and 4,030,536 wherein the relatively longer sides of the mold are flexed during the molding operation to adjust the crown imparted to the wider side walls of the ingot.

While molds of this type can provide a variable crown on the wider side walls of the ingot, they cannot deal in a positive way with the problem of "cold shut" at the corners of the ingot. Instead, they simply provide no cooling effect at all at the corners, and since a cooling effect is desirable on all parts of the ingot including the corners of the same, this "negative solution" to the problem is less than satisfactory.

Also, while molds of the patented type can compensate for variable shrinkage in the wider side walls of the ingot, they cannot do so on a commercial basis since each prior art unit is normally fabricated in situ as a built-up, multi-component assembly which is normally tested and put into operation at the site itself. As such, the equipment cannot be readily economically mass produced on a standardized basis, and cannot be readily economically replaced thereafter when needed.

One object of the present invention therefore, is to provide a direct chill, flat ingot casting mold which not only is capable of imparting a variable crown to the side walls of the ingot, and capable of providing a chill effect at the corners of the mold as well as at the corners of the emerging ingot, but also is machine duplicatable for mass production and replacement purposes. Another object is to provide a mold of this nature which is capable of providing a controlled or modified chill effect at the corners of the mold, and at the corners of the ingot, to avoid the problem of "cold shut" in the corners. Still another object is to provide a mold of this nature which is capable of imparting a variable crown to the side walls of the ingot and a positively controlled chill effect in the corners of the ingot without appreciably reducing the width of the ingot, and in fact, while substantially preserving the flatness of the narrower side walls of the ingot. A still further object is to provide a mold of this nature which is not only machine duplicatable for mass marketing and replacement purposes, i.e., effective commercialization of the same, but also readily transportable to the point of use. Another object is to provide a mold of this nature which can be readily incorporated into the casting equipment and techniques adopted for the prior art units, and in particular the gang molding equipment and techniques adopted for these units. Other objects include the provision of a mold of this nature which is capable of inducing laminar flow in the liquid coolant for the same, and which is also capable of discharging the coolant directly onto the exposed surface of the ingot as it emerges from the mold. Still other objects include the provision of a mold of this nature which is capable of introducing a flow of oil into the top opening of the mold, and which is also capable of providing the oil flow in those portions of the mold which operate to provide a variable crown on the side walls of the ingot. Still further objects will become apparent from the description of the invention which follows hereafter.

According to the invention, these objects and advantages are realized by a flat ingot casting mold comprising a generally rectangularly shaped, machine duplicatable band which is monolithically circumferentially continuous and inherently convexly bowed on the relatively longer and shorter sides thereof so that it forms crowns on the opposing side walls of the ingot operatively formed therein. The bow in the relatively longer sides of the band has an inherent deflection adapted to form a crown intermediate between that adapted to compensate for shrinkage during the butt forming stage of the casting operation, and that adapted to compensate for shrinkage when the casting operation is conducted at operating speed. However, the relatively longer sides of the band are adapted to flex laterally inwardly and outwardly thereof, and there are drive means connected with the relatively longer sides of the band to flex the same, firstly relatively laterally inwardly thereof to alter the deflection to that adapted to compensate for shrinkage during the butt forming stage, and then relatively laterally outwardly thereof to alter the deflection to that adapted to compensate for shrinkage when the casting operation is conducted at operating speed.

Preferably, the bow in the relatively shorter sides of the band also has an inherent deflection adapted to form a crown intermediate that adapted to compensate for shrinkage during the butt forming stage and that adapted to compensate for shrinkage when the operation is conducted at operating speed. Depending on operating needs, the relatively shorter sides may be given an inherent deflection which is an average of that needed during the entire operation, and may be constructed or restrained in the mold so that they are fixed against flexure from said deflection. Or alternatively, the relatively shorter sides may be adapted to flex laterally inwardly and outwardly of the band, and they may be freely disposed in the mold to undergo flexure in response to flexure of the longer sides of the band, but in inverse relationship thereto.

Typically, the drive means are connected with the longer sides of the band adjacent the midpoints thereof, and are operative to flex the longer sides in unison with one another. For example, in one embodiment of the invention, the drive means include a rotatable drive shaft which has right and left hand threading on alternate portions thereof, and there are means threadedly interconnected between the threaded portions of the shaft and the longer sides of the band to generate corresponding laterally directed displacement forces on the sides when the shaft is rotated in one direction, and opposite corresponding laterally directed forces on the sides when the shaft is rotated in the other direction.

In practice, the mold also comprises coolant supply means which are operable to apply liquid coolant to the inner peripheral facial portion of the band to cool the ingot metal. For example, in the presently preferred embodiments of the invention the coolant supply means include a second generally rectangularly shaped, machine duplicatable band which is also monolithically circumferentially continuous and inherently convexly bowed on the relatively longer and shorter sides thereof. During the casting operation, the second band is operatively coaxially arranged about the first-mentioned band in a common plane therewith, and is adapted so that the respective outer and inner peripheral faces of the bands abut one another to form an annular joint therebetween, about which the bodies of the bands can shift in relation to one another relatively circumferentially of their axis. The two bands are also adapted so that they form a sealed chamber in the region of the joint, to receive the coolant, and there are first coolant feed means operable to introduce the coolant to the chamber, and second coolant feed means interconnected with the chamber to meter the coolant through the inner peripheral facial portion of the first-mentioned band to cool the same. In addition, the relatively longer sides of the second band are adapted to flex in conjunction with the relatively longer sides of the first-mentioned band, and the drive means is operative to flex the relatively longer sides of the respective bands in unison with one another to preserve the seal on the chamber when the deflection in the bow of the longer sides of the first-mentioned band is altered.

In practice moreover, the mold also comprises coolant supply means which are operable to discharge coolant onto the ingot as it emerges from one axial end of the first-mentioned band. For example, in the presently preferred embodiments of the invention, the aforementioned second coolant feed means is interconnected with the one axial end of the first-mentioned band to discharge the coolant from the chamber onto the ingot after the coolant has cooled the inner peripheral facial portion of the first-mentioned band.

To illustrate more specifically, in certain of the presently preferred embodiments of the invention, the respective outer and inner peripheral faces of the first and second-mentioned bands have circumferential grooves therein which are substantially mutually opposed to one another at the joint to define an annular chamber for the coolant; the aforementioned first coolant feed means is interconnected with the groove in the second band; and there is a circumferentially continuous membraneous band interposed between the grooves as a septum, which has apertures in one edge portion thereof that meter the coolant into the groove in the first-mentioned band around the periphery thereof; whereafter the coolant is applied to the inner peripheral facial portion of the first-mentioned band by passage means thereadjacent that communicate with the one axial end portion of said band, to cool the band and to discharge the coolant from said band about the emerging ingot. Preferably, the groove in the first-mentioned band is axially wide and radially deep and there are apertures in the one axial end portion of the first-mentioned band which communicate with said groove adjacent the other edge portion of the membraneous band and open into the one axial end of the first-mentioned band adjacent the inner peripheral face thereof. Preferably too, the apertures in the first-mentioned band are spaced apart from one another about the circumference of the mold and are offset from the inner peripheral facial plane of the first-mentioned band at a greater distance in the corner portions of the mold than along the relatively longer and shorter sides thereof. In this way, the coolant is caused to impinge on the ingot at points more distant from the one axial end of the band at the corners of the mold, than it impinges along the relatively longer and shorter sides of the same. This in turn tends to compensate for the fact that the ingot is cooled from both sides at the corners of the mold.

It is also preferred to thicken the bands in the radial sense at the corners of the mold, not only to provide more body to accomodate the relatively offset apertures and to rigidify the mold at these points, but also to provide more body with which to alter the cooling effect of the applied coolant at the corners.

Preferably too, the coolant is introduced to the groove in the second band through relatively radially embossed ports in the relatively shorter sides of the same, so as to rigidify those sides somewhat; and there are annular sealing members interposed between the bands at the joint, adjacent the axial end portions of the same, to seal the chamber formed by the grooves in the bands.

The one axial end of the first-mentioned band may be adapted to form a continuous slot therearound for discharging the coolant as a curtain thereof. Also, there may be means on the other axial end of the first-mentioned band for feeding oil into the opening of the mold; and the oil feed means may include means for feeding the oil through the connections between the drive means and the respective longer sides of the bands.

BRIEF DESCRIPTION OF THE DRAWINGS

These features will be better understood by reference to the accompanying drawings which illustrate certain of the aforementioned embodiments of the invention when it is employed in a vertical gang mold assembly.

In the drawings,

FIG. 1 is an exploded perspective view of one mold in the gang, with certain components omitted for clarity;

FIG. 2 is a radial cross section through the mold at the center of one of the longer sides thereof;

FIG. 4 is a part radial cross section along the line 4—4 of FIG. 3;

FIG. 7 is a bottom view of one corner of still another version.

DESCRIPTION OF THE PREFERRED EMBODIMENTS

Figure 3:
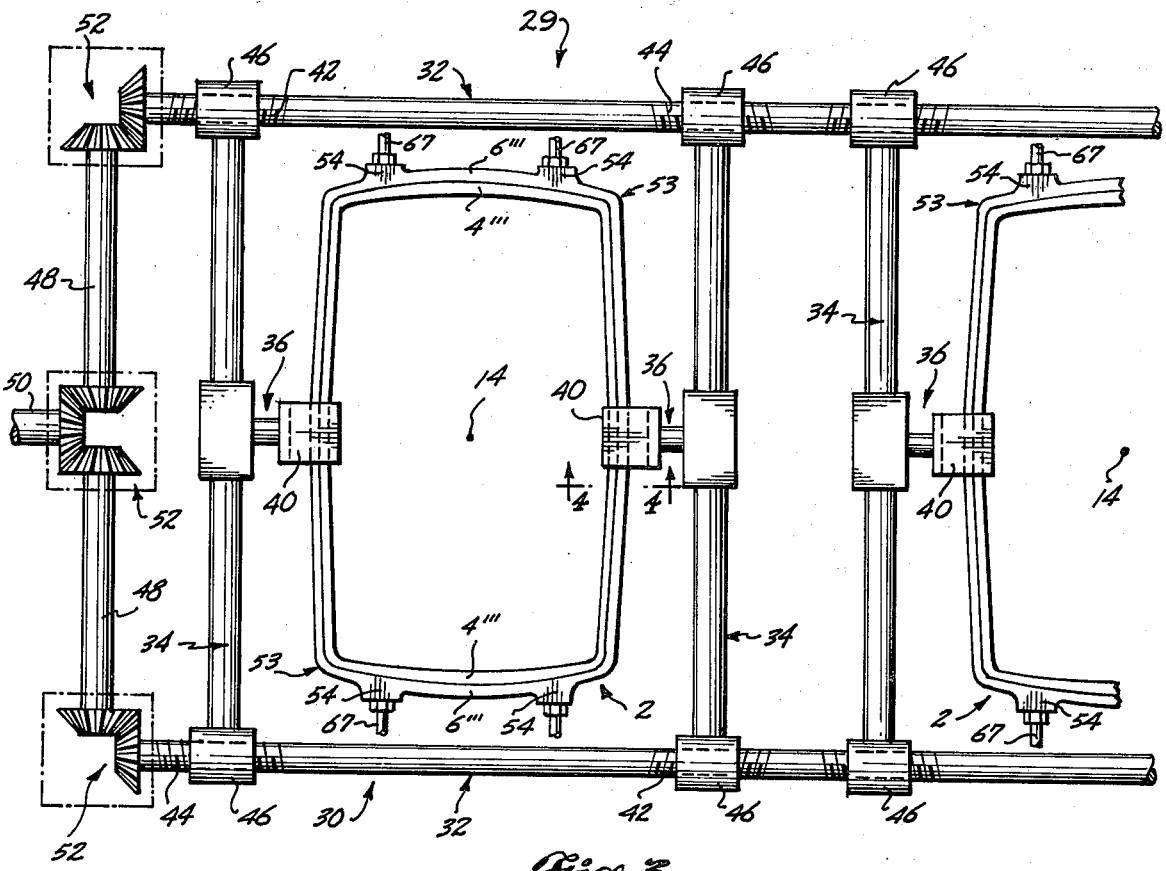
FIG. 3 is a part plan view of the gang mold.

Referring to the drawings, it will be seen that each mold 2 comprises a generally rectangularly shaped, machine duplicatable, metal band 4 which is monolithically circumferentially continuous and inherently convexly bowed on the relatively longer and shorter sides 4' and 4'', respectively, thereof, so that it forms crowns on the opposing side walls of the ingot 100 operatively formed therein. The bow in the relatively longer sides 4' of the band has an inherent deflection adapted to form a crown intermediate between that adapted to compensate for shrinkage during the butt forming stage of the ingot casting operation, and that adapted to compensate for shrinkage when the ingot casting operation is conducted at operating speed. However, the relatively longer sides 4' of the band are adapted to flex laterally inwardly and outwardly thereof, and there are drive means 29 (FIG. 3) connected with the relatively longer sides of the band to flex the same, firstly relatively laterally inwardly thereof to alter the deflection to that adapted to compensate for shrinkage during the butt forming stage, and thence relatively laterally outwardly thereof to alter the deflection to that adapted to compensate for shrinkage when the casting operation is conducted at operating speed. The bow in the relatively shorter sides 4'' of the band also has an inherent deflection adapted to form a crown intermediate that adapted to compensate for shrinkage during the butt forming stage, and that adapted to compensate for shrinkage when the operation is conducted at operating speed. The deflection is an average of that needed during the entire operation and the sides 4'' are adapted to flex laterally inwardly and outwardly of the band and are freely disposed in the mold to undergo flexure in response to flexure of the longer sides 4' of the band, but in inverse relationship thereto.

During the casting operation, liquid coolant such as water is applied to that portion of the mold adjacent the inner peripheral face 26 of the band to cool the molten ingot metal. The mold also comprises a second generally rectangularly shaped, machine duplicatable band 6 which is also monolithically circumferentially continuous and inherently convexly bowed on the relatively longer and shorter sides 6' and 6'', respectively, thereof. During the operation, the second band 6 is operatively coaxially arranged about the band 4 in a common plane therewith, and is adapted so that the respective outer and inner peripheral faces 8 and 10 of the bands abut one another to form an annular joint 12 therebetween, along which the bodies of the band can shift in relation to one another relatively circumferentially of their axis 14. In the region of the joint, the two bands form a sealed chamber 20 to receive the coolant, and there are ports 54 in the end portions of the relatively shorter sides 6'' of the second band 6 which introduce the coolant to the chamber; and coolant feed means 18 interconnected with the chamber to meter the coolant through the inner peripheral facial portion of the band 4. In addition, the relatively longer sides 6'' of the second band 6 are adapted to flex in conjunction with the relatively longer sides 4'' of the band 4, and the drive means 29 is operative to flex the relatively longer sides 4'' and 6'' of the respective bands in unison with one another to preserve the seal 28 on the chamber when the deflection in the bow of the longer sides 4'' of the band 4 is altered.

The mold also comprises coolant supply means 24 which interconnect the coolant feed means 18 with the lower axial end 22 of the band 4 to discharge the coolant from the chamber onto the ingot after the coolant has cooled the inner peripheral facial portion of the band 4.

More specifically, the respective outer and inner peripheral faces 8 and 10 of the bands 4 and 6 have circumferential grooves 16 and 56 therein which are substantially mutually opposed to one another at the joint 12 to define the chamber 20 for the coolant; and there is a circumferentially continuous membraneous band 64 interposed between the grooves as a septum, which has apertures 66 in the upper edge portion thereof that meter the coolant into the groove 16 in the band 4. The groove 16 is axially wide and radially deep so that the true radial thickness of the band 4 is uniformly shallow and the coolant is thus applied to the inner peripheral facial portion of the band 4 during its passage downward in the groove. Thereafter, circumferentially spaced passages 84 in the band intercommunicate between the bottom of the groove 16 and the lower axial end 22 of the band to discharge the coolant from the band about the emerging ingot. The end openings 85 of the passages are spaced apart from one another about the circumference of the mold, and in the case of the embodiment in FIG. 7, are offset from the inner peripheral facial plane 26 of the band 4 at a greater distance in the corner portions 53' of the mold than along the relatively longer and shorter sides 4', 6' and 4'', 6'' thereof. In this latter embodiment, moreover, the bands are thickened in the radial sense at the corner portions of the mold to provide more body 120 for offsetting the end openings of the passages 84'' at these points, and to provide more body with which to alter the cooling effect of the applied coolant at the corners.

The upper and lower edges of the groove 16 are rabbetted to provide steps 60 and 62 on which to seat the membraneous band 64.

The drive means 29 comprises a horizontal frame 30 which is rectangular in shape and has the molds arranged upright therein with their longer sides 4', 6' crosswise those of the frame. The frame comprises a pair of spaced parallel drive shafts 32 that run lengthwise of the frame and have pairs of spaced parallel crossbars 34 therebetween. The crossbars have pairs of mutually centrally aligned tees 36 affixed thereon, which are directed toward one another in the spaces between the respective bars. The molds are centrally disposed between the respective tees, and the longer sides 4', 6' of the molds are connected with the heads 38 of the tees by pairs of channel-shaped clips 40 which also operate to retain the bands in coplanar relationship. In addition, the shafts 32 have alternately right and left hand threading 42 and 44 thereon at the ends of the crossbars, and the crossbars are threadedly interconnected with the shafts by pairs of correspondingly threaded sleeves 46 that are journaled on the threading 42, 44 and connected to the ends of the bars. In this way, unidirectional rotation of the shafts causes the respective pairs of bars to translate in opposite directions lengthwise of the frame, and to cause the clips 40 to apply opposite lateral displacement forces to the longer sides 4', 6' of the respective molds, radially outwardly of their axes, and alternately, radially inwardly of their axes. The rotation may be generated by a motor (not shown) which is interconnected with the shafts through an intermediate drive train comprising a pair of intermediate drive shafts 48 and a main drive shaft 50, all of which are interconnected with one another and with the shafts 32 by pairs of bevel gears 52.

The shorter sides 6'' of the band 6 in each mold have internally threaded embossments 54 at the sites of the ports 58, and flexible coolant supply hoses 67 are threadedly interconnected with the ports in the embossments. The embossments may be configured as street ells to enable the coolant to be fed from below. The embossments also add rigidity to the shorter sides 6'' of the band 6; and preferably, the center portions 4''' and 6''' of the shorter sides 4'' and 6'' of the respective bands 4 and 6 are also radially thickened in relation to the longer sides 4' and 6' thereof for this purpose.

The means for sealing the chamber 20 in the joint 12 take the form of elastomeric O rings 68 and 70 which are disposed in circumferential grooves 72 and 74 in the faces 8 and 10 of the bands. The grooves may be formed in alternate lands between the grooves 16, 56 and the axial ends 22, 23 and 76, 77 of the bands 4 and 6, respectively, as in FIGS. 1–4; or they may be formed in the lands on only one of the faces 8, 10, as in FIG. 5. The arrangement in FIGS. 1–4 has the advantage, however, that the rings can be more easily seen when the bands are assembled to form the mold.

Non-hardening silicone rubber or the like may be substituted for the rings if desired.

Preferably, the band 6 also has a step 78 (FIG. 2) rabbetted into the upper axial end 76 thereof, at the inner peripheral edge thereof; and the upper axial end 23 of the band 4 is slightly raised in relation to the band 6 and has a radially outwardly extending lip 80 thereon which bridges over the step and forms a seat for a third elastomeric O ring 82.

The end openings 85 of the passages 84 are inclined to the axis 14 of each mold and open into a chamfered surface on the end 22 of the band 4. The surface is more radially outwardly offset at the corners of the mold, as seen as 85' in FIG. 7. Also, a step 87 is formed along a line relatively radially outwardly offset from the chamfered surface of the band to take the bottom clips 40 of the gang drive assembly 29 as seen in FIG. 4.

Figure 5:
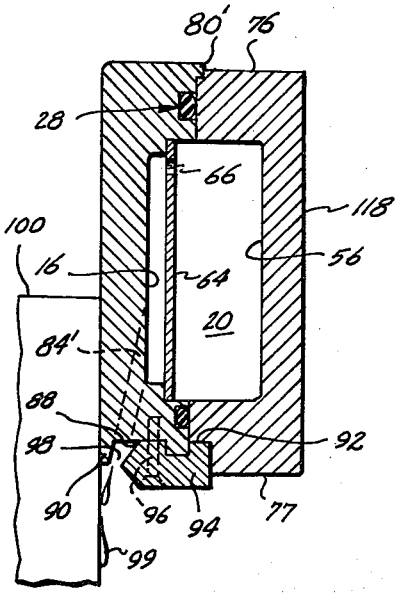
FIG. 5 is a radial cross section of a modified version of the mold shown in FIGS. 1–4.

In FIG. 5, the lower end 22 of the band 4 has a circumferential groove 88 therein, the inner peripheral wall of which is chamfered to form a depending lip 90 for the passages 84' which in this instance are more steeply inclined to the axis and open out of the groove 16 at locations in the vertical face thereof. Also, the lower axial end 77 of the band 6 depends below the band 4 and has a step 92 formed in the inner peripheral edge thereof, so that a slant nosed, clip-like ring 94 can be attached to the band 4 by screws 96 to cooperate with the depending lip 90 in forming a continuous slot 98 about the mold for the coolant discharge. In this way, the discharge will form more of a "curtain" 99 of coolant flow over the emerging portion of the ingot 100.

Additionally, in FIG. 5, the upper axial end 23 of the band 4 continues to have a lip 80' thereon, and together the ring 94 and the lip provide a means for maintaining the coplanar relationship of the bands. The ring 94 may also serve as part of the connection between the bands and the gang drive assembly 29.

Figure 6:
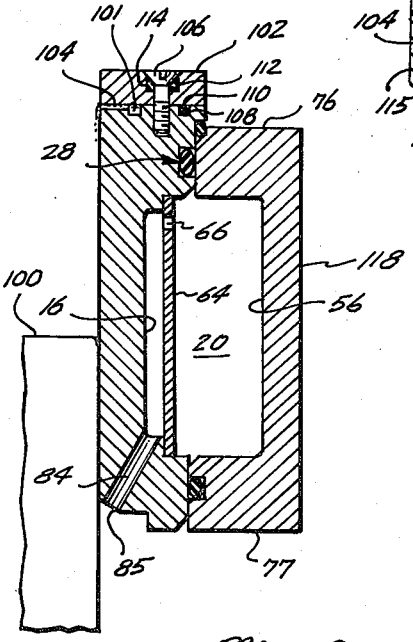
FIG. 6 is a similar view of another version.
Figure 6A:
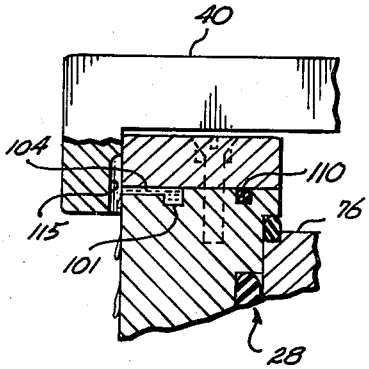
FIG. 6A is a somewhat enlarged part radial cross section of the latter version at the site of a connection between the drive means and the longer sides of the bands.

In FIGS. 6 and 6A, the upper axial end 23 of the band 4 has a circumferential groove 101 therein, to form an oil manifold for the mold. The end 23 also has radial grooves 104 therein which feed the oil toward the inner peripheral face 26 of the band 4. The respective grooves 101 and 104 are covered by a ring 102 which is attached to the end 23 of the band by screws 106. Preferably, the band 4 is also equipped with a more outlying circumferential groove 108, to accommodate an additional sealing ring 110; and the screws 106 are countersunk in recesses 112 equipped with individual sealing rings 114.

At the sites of the clips 40, the oil is fed by grooves 115 in the upper lips of the clips, which register with the outlet ends of the grooves 104.

Typically, the bands 4 and 6 are machined so that the sides 4', 6' and 4'', 6'' only approximate convexly curved lines, and as seen in FIG. 1, each of the longer sides 4'', 6'' has three sections, including intermediate sections 116 and 118, respectively. In other embodiments, the sides may have as few as two sections, or as many as seven or more sections.

At the corners, the sides and corners flare smoothly into one another, as seen in FIG. 7.

The bands are made by conventional machining techniques, particularly those which lend themselves to computerization.

What is claimed is:

1. A flat ingot casting mold having a mold-cavity defining member at the inner periphery thereof which comprises a generally rectangularly shaped band that is monolithically continuous about the circumference thereof, including at the corners of the cavity, and inherently convexly bowed on the relatively longer and shorter sides thereof so that it forms crowns on the opposing side walls of the ingot operatively formed in the cavity, the bow in the relatively longer sides of the band having an inherent deflection adapted to form a crown intermediate between that adapted to compensate for shrinkage during the butt forming stage of the casting operation and that adapted to compensate for shrinkage when the casting operation is conducted at operating speed, but the relatively longer sides of the band being adapted to flex laterally inwardly and outwardly thereof and there being drive means connected with the relatively longer sides of the band to flex the same, firstly relatively laterally inwardly thereof to alter the deflection to that adapted to compensate for shrinkage during the butt forming stage, and thence relatively laterally outwardly thereof to alter the deflection to that adapted to compensate for shrinkage when the casting operation is conducted at operating speed, and there also being coolant delivery apertures in one axial end of the band adjacent the inner peripheral face thereof, which are spaced apart from one another about the circumference of the mold and offset from the inner peripheral facial plane of the band at a greater distance in the corner portions of the same than along the relatively longer and shorter sides thereof, to discharge the coolant so that it impinges on the ingot at points more distant from the one axial end of the band at the corners of the mold, than it impinges on the ingot along the relatively longer and shorter sides of the mold.

2. The mold according to claim 1 wherein the band is relatively thickened in the radial sense at the corners of the mold.

3. A mold cavity defining member for a flat ingot casting mold, comprising a generally rectangularly shaped band that is monolithically continuous about the circumference thereof, including at the corners thereof, and inherently convexly bowed on the relatively longer and shorter sides thereof so that it forms crowns on the opposing side walls of the ingot operatively formed in the cavity, the bow in the relatively longer sides of the band having an inherent deflection adapted to form a crown intermediate between that adapted to compensate for shrinkage during the butt forming stage of the casting operation and that adapted to compensate for shrinkage when the casting operation is conducted at operating speed, but the relatively longer sides of the band being adapted to flex laterally inwardly and outwardly thereof, so that said sides can be flexed relatively laterally inwardly thereof to alter the deflection to that adapted to compensate for shrinkage during the butt forming stage, and thence relatively laterally outwardly thereof to alter the deflection to that adapted to compensate for shrinkage when the casting operation is conducted at operating speed, there being coolant delivery apertures in one axial end of the band adjacent the inner peripheral face thereof, which are spaced apart from one another about the circumference of the mold, and offset from the inner peripheral facial plane of the band at a greater distance in the corner portions of the mold than along the relatively longer and shorter sides thereof, to discharge the coolant so that it impinges on the ingot at points more distant from the one axial end of the band at the corners of the mold, than it impinges on the ingot along the relatively longer and shorter sides of the mold.

4. The mold according to claim 3 wherein the band is relatively thickened in the radial sense at the corners thereof.

5. A flat ingot casting mold comprising a generally rectangularly shaped, machine duplicatable band which is monolithically circumferentially continuous and inherently convexly bowed on the relatively longer and shorter sides thereof, so that it forms crowns on the opposing side walls of the ingot operatively formed therein, the bow in the relatively longer sides of the band having an inherent deflection adapted to form a crown intermediate between that adapted to compensate for shrinkage during the butt forming stage of the casting operation, and that adapted to compensate for shrinkage when the casting operation is conducted at operating speed, but the relatively longer sides of the band being adapted to flex laterally inwardly and outwardly thereof, and there being drive means connected with the relatively longer sides of the band to flex the same, firstly relatively laterally inwardly thereof to alter the deflection to that adapted to compensate for shrinkage during the butt forming stage, and thence relatively laterally outwardly thereof to alter the deflection to that adapted to compensate for shrinkage when the casting operation is conducted at operating speed, said mold further comprising coolant supply means which are operable to apply liquid coolant to the inner peripheral facial portion of the band to cool the ingot metal, said coolant supply means including a second generally rectangularly shaped, machine duplicatable band which is also monolithically circumferentially continuous and inherently convexly bowed on the relatively longer and shorter sides thereof, said second band being operatively coaxially arranged about the first-mentioned band in a common plane therewith, and adapted so that the respective outer and inner peripheral faces of the bands abut one another to form an annular joint therebetween, about which the bodies of the bands can shift in relation to one another relatively circumferentially of their axis, the bands being adapted so that they form a sealed chamber in the region of the joint, to receive the coolant, and there being first coolant feed means operable to introduce the coolant to the chamber, and second coolant feed means interconnected with the chamber to meter the coolant through the inner peripheral facial portion of the first-mentioned band to cool the same, the relatively longer sides of the second band being adapted to flex in conjunction with the relatively longer sides of the first-mentioned band, and the drive means being operative to flex the relatively longer sides of the respective bands in unison with one another to preserve the seal on the chamber when the deflection in the bow of the longer sides of the first-mentioned band is altered, the second coolant feed means being interconnected with one axial end of the first-mentioned band to discharge the coolant from the chamber onto the ingot after the coolant has cooled the inner peripheral facial portion of the first-mentioned band, and the respective outer and inner peripheral faces of the first and second-mentioned bands having circumferential grooves therein which are substantially mutually opposed to one another at the joint to define an annular chamber for the coolant; the aforementioned first coolant feed means being interconnected with the groove in the second band; there being a circumferentially continuous membraneous band interposed between the grooves as a septum, which has apertures in one edge portion thereof that meter the coolant into the groove in the first-mentioned band around the periphery thereof; and there being passage means adjacent the inner peripheral facial portion of the first mentioned band that communicate with the one axial end portion of said band, to cool the band and to discharge the coolant from said band about the emerging ingot, the groove in the first-mentioned band being axially wide and radially deep and there being apertures in the one axial end portion of the first-mentioned band which communicate with said groove adjacent the other edge portion of the membraneous band and open into the one axial end of the first-mentioned band adjacent the inner peripheral face thereof, the apertures in the first-mentioned band being spaced apart from one another about the circumference of the mold and offset from the inner peripheral facial plane of the first-mentioned band at a greater distance in the corner portions of the mold than along the relatively longer and shorter sides thereof to cause the coolant to impinge on the ingot at points more distant from the one axial end of the band at the corners of the mold, than it impinges along the relatively longer and shorter sides of the same.

6. The mold according to claim 5 wherein the bands are relatively thickened in the radial sense at the corners of the mold.

* * * * *